US007114456B2

(12) United States Patent
Sohy

(10) Patent No.: US 7,114,456 B2
(45) Date of Patent: Oct. 3, 2006

(54) REVERSIBLE CAMBER AIRFOIL

(76) Inventor: Michael A. Sohy, 25763 Robertson Cr., Aldergrove BC (CA) V4W1W4

( * ) Notice: Subject to any disclaimer, the term of this patent is extended or adjusted under 35 U.S.C. 154(b) by 0 days.

(21) Appl. No.: 11/240,502

(22) Filed: Oct. 3, 2005

(65) Prior Publication Data

US 2006/0118020 A1 Jun. 8, 2006

Related U.S. Application Data

(60) Provisional application No. 60/615,645, filed on Oct. 4, 2004.

(51) Int. Cl.
*B63H 9/04* (2006.01)

(52) U.S. Cl. ..... 114/102.22

(58) Field of Classification Search ..... 114/102.1, 114/102.22

See application file for complete search history.

(56) References Cited

U.S. PATENT DOCUMENTS 6,892,659 B1 * 5/2005 Petretto ..... 114/102.22

FOREIGN PATENT DOCUMENTS

WO WO 03/024782 A1 * 3/2003 ..... 114/102.22

* cited by examiner

*Primary Examiner*—Stephen Avila

(57) ABSTRACT

A reversible camber airfoil rib has a first side and a second side that are adjoined at an angle along an interrupted common inner edge extending longitudinally from a leading edge to a trailing edge. An aperture extends through the common inner edge and enables the rib to pivotally couple with a mast about an axis that is transverse to the mast axis. The aperture also allows the rib to slide along the mast. Each of the sides of the rib has a cambered outer edge which supports an airfoil surface. A plurality of the ribs and attending components when enclosed in a flexible covering provides a reversible camber airfoil for use on a wind-powered vehicle.

10 Claims, 8 Drawing Sheets

REVERSIBLE CAMBER AIRFOIL

CROSS-REFERENCE TO RELATED APPLICATIONS

This application is related to U.S. provisional application No. 60/615,645 filed Oct. 4, 2004, entitled "Reversible Camber Wing Sail", naming Michael A. Sohy as the inventor. The benefit of the filing date of the provisional application is hereby claimed for all purposes that are legally served by such claim for the benefit of the filing date.

FEDERALLY SPONSORED RESEARCH

Not Applicable

SEQUENCE LISTING OR PROGRAM

Not Applicable

FIELD OF THE INVENTION

The present invention relates to airfoils for use on wind powered vehicles. More specifically, the invention relates to a reversible camber airfoil which can be used to support an airfoil shape in a wing sail.

BACKGROUND OF THE INVENTION

The relative motion of a wind powered vehicle with regards to the wind is often referred to as sailing upwind, or sailing downwind. Sailing downwind is accomplished by positioning sails to create as much drag as possible. The resulting wind pressure on the sails "pushes" the vehicle along in the direction of the wind. Essentially any shape that effectively creates drag can be used for downwind sailing. However, when sailing upwind or into the wind, sail shape becomes much more important. In order to sail upwind, the sails are positioned to generate aerodynamic lift in relation to the apparent wind. It is this lift that is translated into the driving force that propels the vehicle forward. When sailing upwind, drag is no longer beneficial, as it counteracts the resulting drive force. Therefore, it is important to developing sails that maximize lift while minimizing drag for sailing into the wind.

Those within the sailing community continue to improve upon existing techniques and create new designs to improve the performance of sails. Certain unconventional designs have an airfoil shape similar to the shape of an airplane wing. The same aerodynamic principles which apply to horizontal aircraft wings also apply, when the wing is placed on end in the vertical axis. When used by wind powered vehicles such as sailboats, these vertical airfoils are often referred to as wing sails.

Wing sails differ from conventional sails in that they have two surfaces of curvature rather than a single thin surface. These two surfaces create a pressure differential by forcing air to flow past them at different velocities, thus creating lift. As a result, high lift airfoils are asymmetrical and will only generate lift efficiently in one direction. This limitation presents a challenge when sailing, where the sail airfoil camber is required to reverse in order to tack. Conventional sails are able to reverse due to the flexibility of their material. However, tacking in this manner is more difficult with a wing sail due to its thick three dimensional shape.

In order to address this tacking issue, numerous wing sails with unique configurations have been developed. One general category is that of a semi rigid or soft wing sail consisting of a flexible covering supported by internal ribs or battens.

An example in the prior art of a soft wing sail capable of tacking is Orrison's Air Foil with Reversible Camber, U.S. Pat. No. 4,341,176. This document discloses an airfoil having a configuration of a plurality of rigid spars, moveable bars, and flexible slats, all covered by a flexible and moveable skin. This airfoil is designed to provide lift which is automatically reversed by changing the angle of incidence of the wind upon the airfoil, resulting in lift in the opposite direction. This design develops an asymmetrical airfoil, while still allowing for efficient tacking by reversing the camber from one side of the sail to the other. One of the limitations of this device is that the airfoil camber is automatically adjusted by the angle of the incident wind. As such, it does not provide a mechanism for manually adjusting the airfoil camber. Another limitation is that it does not provide a neutral symmetrical orientation between the asymmetrical orientations.

U.S. Pat. No. 4,757,779 discloses a reversible airfoil having manual control of the camber of the sail. The disadvantages of this sail are that the airfoil control lines are external to the sail structure, and that the leading edge of the sail requires inflating. The external lines could add drag, may potentially get tangled, and prevent the sail from rotating 360 degrees. The inflatable balloon structure in the leading edge may also interfere with raising and lowering of the sail. It is also at risk for punctures, leading to deflation of the leading edge.

U.S. Pat. No. 4,386,574 describes a sail assembly that is reversible, has a variable profile, and is collapsible. The invention provides a means for control of the airfoil profile independent of the wind. A limitation of this sail assembly is the complex mechanical system of cams, gears, and motors required to adjust the airfoil profile.

U.S. Pat. No. 4,624,203 discloses a batten structure for a soft wing sail. This batten structure allows for both manual and automatic control of the airfoil camber. A limitation of this structure is the number of parts required for the batten structure.

U.S. Pat. No. 5,271,349, also discloses a soft wing sail structure where the airfoil shape is automatically controlled by the wind due to the frequent changes in the force of the wind. With this invention, airfoil shape is limited to adjustments of the tail of the airfoil ribs. It also has a number of linkage mechanisms that add weight and complexity. One of the concerns of automatic control is that the airfoil camber could automatically reverse in turbulent airflow. Automatic control may also be ineffective during periods of strong gusting or light winds.

It is the object of the present invention to overcome the noted disadvantages of the prior art.

SUMMARY OF THE INVENTION

It is therefore one object of the invention to provide a reversible camber airfoil rib for supporting an airfoil surface for use on wind-powered vehicles. In one aspect of the invention, an airfoil rib has a first side and a second side that are adjoined at an angle along an interrupted common inner edge extending longitudinally from a leading edge to a trailing edge of the rib. An aperture extends through the common inner edge and enables the rib to pivotally couple with a mast about an axis that is transverse to the mast axis.

The aperture also allows the rib to slide along the mast. Each of the sides of the rib has a cambered outer edge which provides support for a reversible camber airfoil surface.

In a further embodiment of the invention, the ribs are used to provide an airfoil shape to a wing sail. The sail comprises: a rotatable mast, a plurality of ribs, a trimming means, a lifting means, and a flexible cover. The ribs, are pivotally coupled to the mast about an associated rib axis extending transversely in relation to the mast axis, and each slidably moveable along the mast when so coupled. Each of the ribs has a first side and a second side that are adjoined at an angle along an interrupted common inner edge extending longitudinally from a leading edge to a trailing edge. An aperture extends through the common inner edge and enables the rib to pivotally couple with the mast about an axis that is transverse to the mast axis. The aperture also allows the rib to slide along the mast. Each of the sides of the rib has a cambered outer edge which provides support for a reversible camber airfoil surface. The trimming means engages the ribs and is operative when the ribs are mounted to the mast, to pivotally move the ribs about their associated axis between neutral and asymmetrical pivot positions. This rockable motion of the rib permits reversible and variable camber adjustment of the wing sail. The lifting means for engaging the ribs and which is operative when the ribs are mounted to the mast are used for slidably lifting the ribs along the mast from respective lowermost positions to respective upper positions. The flexible cover extends over the ribs and provides a sail surface conforming to and supported by the ribs.

The wing sail as described is able to adjust the camber of the airfoil shape and reverse the camber from one side of the sail to the other as would be useful when tacking. The sail is capable of being trimmed, raised and lowered and removed from the mast in a manner similar to that of a conventional sail. The wing sail is also functionally similar to a conventional sail as it allows for tacking and reefing, while being superior to conventional sails in terms of efficiency. Reversing the airfoil camber without adjusting the angle of the airfoil into the wind, allows the airfoil to act as an airbrake or even allow the craft to sail in reverse. When the airfoil is pointed straight into the wind, with a neutral camber orientation, no lift will be created, and it will not create the noisy luffing event often experienced with conventional sails. As it relates to the prior art, the present invention is designed to reduce the complexity of construction and improve the functionality of operating a reversible camber airfoil as used in a wing sail for a wind powered vehicle. Additional objects and advantages of the invention will become apparent from a consideration of the drawings and description.

DRAWING REFERENCE NUMERALS

Figure 1:
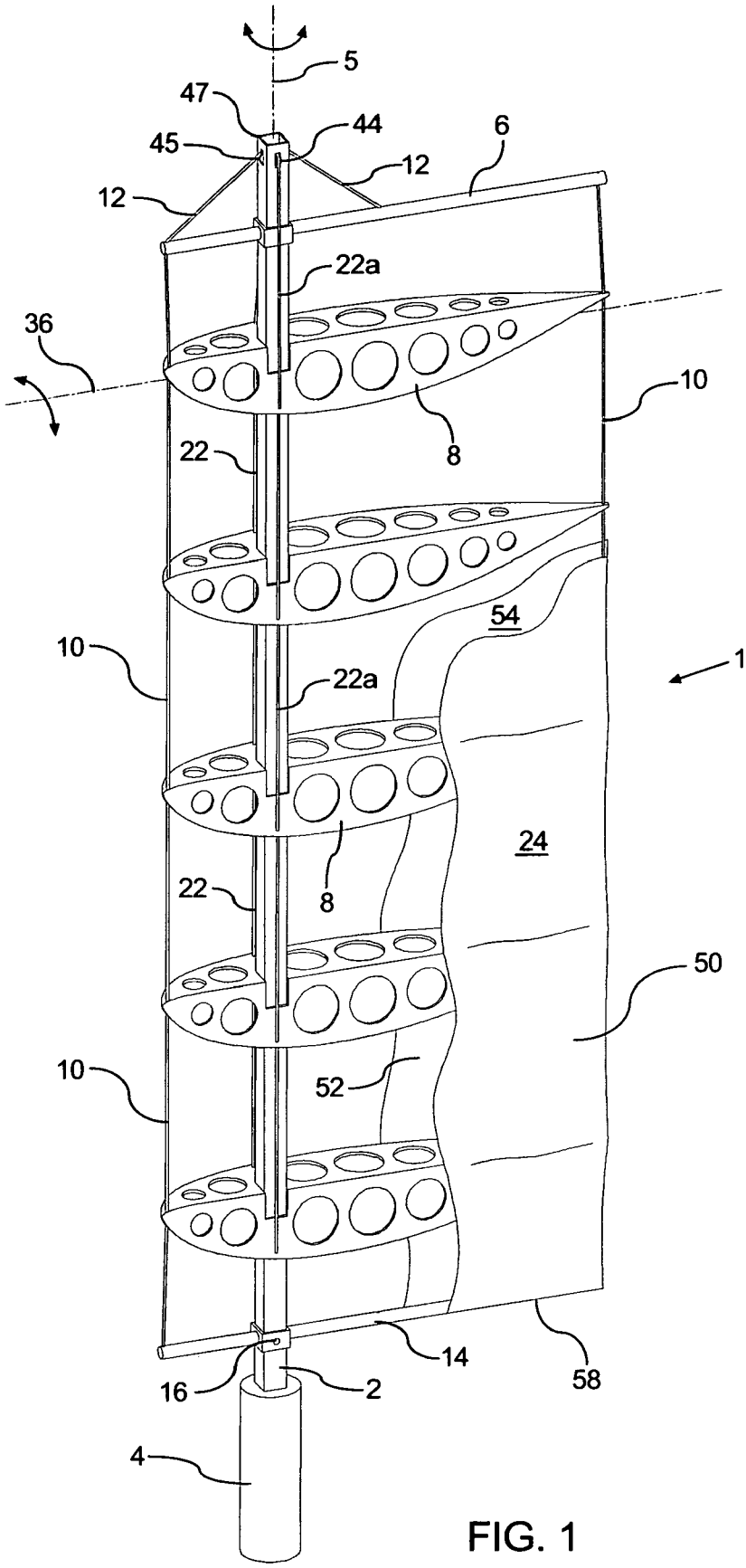
FIG. 1 shows a perspective view of a wing sail with ribs exposed.

1 Wing sail
2 Mast
4 Base
5 Mast axis
6 Upper support
8 Rib
10 Spacer
12 Halyard line
14 Lower support
16 Pin
17 Trim line aperture
18 Round apertures
20 Rib aperture
22 Trim line
**22*a*** Trim line
24 Flexible cover
28 Sail boat
30 First side of rib
**30*a*** Second side of rib
31 Cambered outer edge
**31*a*** Cambered outer edge
32 Common inner edge
33 Leading edge
34 Trailing edge
35 Hinge
36 Rib axis
38 Forward portion of rib
40 Rearward portion of rib
42 Mechanical fasteners
44 Trim line pulley
45 Halyard pulley
47 Top of mast
50 First side of cover
52 Second side of cover
54 Cavity formed by cover
56 Top of cover
58 Bottom of cover
60 Mesh
61 Spacer connection aperture
66 Rotating block
68 Sliding pin

DETAILED DESCRIPTION OF THE INVENTION

Figure 9:
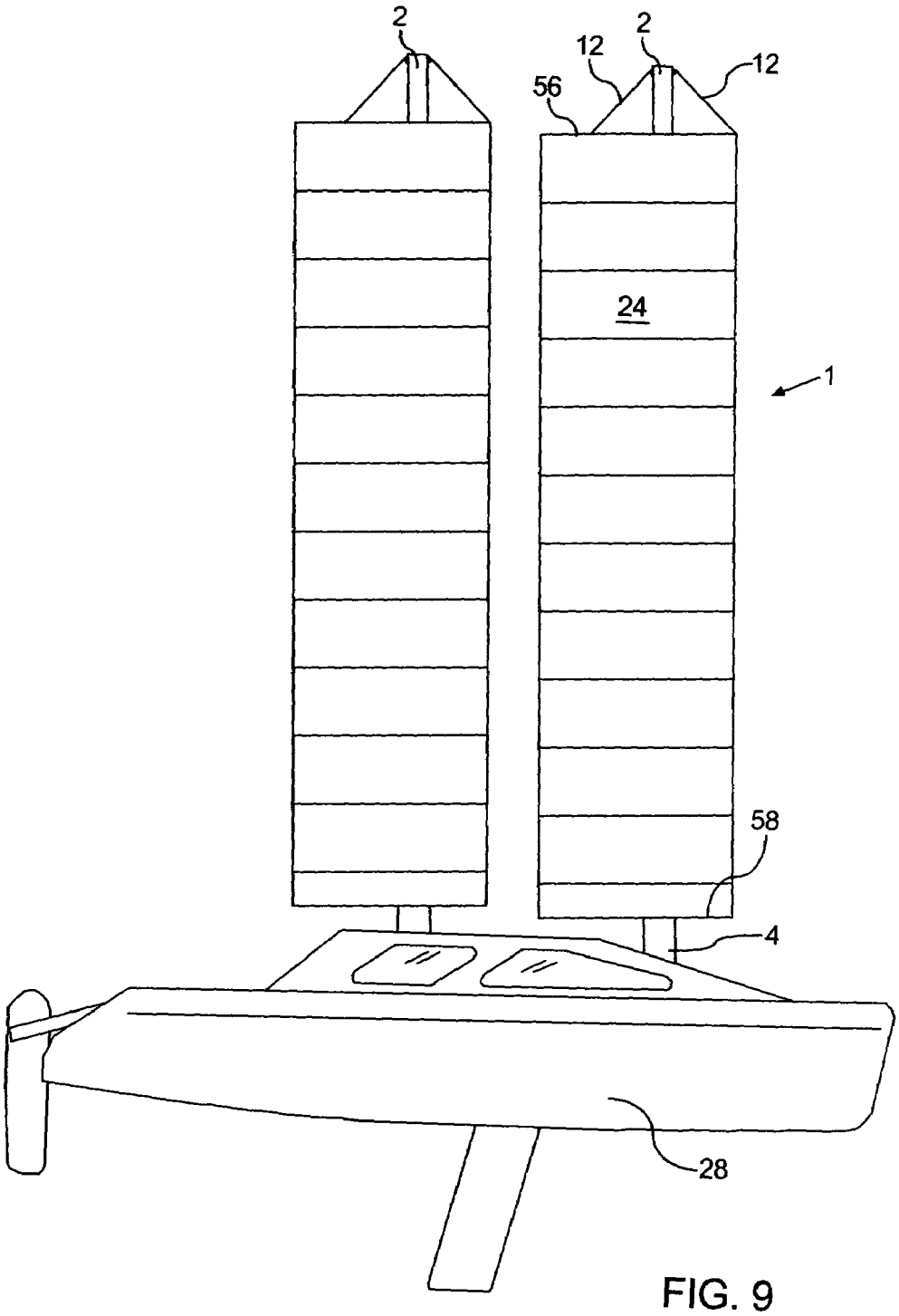
FIG. 9 is a side view of a pair of wing sails mounted on a sail boat.

FIG. 1 illustrates a wing sail 1 according to the invention for use with a wind powered vehicle The wing sail 1 shown in FIG. 1 includes a mast 2 which is mounted to a base 4 for rotation about a mast axis 5 such that the angle of attack of the wingsail 1 may be adjusted. The base 4 is attached to a sailboat 28 as shown in FIG. 9. The means for securing and rotating the mast 2 is not shown, as such means are well known in the art, and are considered to be conventional. The mast 2 is free standing which simplifies the design and improves the aerodynamics of the airfoil by not having standing rigging exposed to the wind, thereby creating drag. In a preferred embodiment, the mast 2 has a substantially square or rectangular hollow cross section and remains uniform along the length of the mast 2. This avoids the costs and complexity of using a tapered or non-uniform shaped mast 2. Preferably the mast 2 is made of a light weight, rigid material such as aluminum, carbon fiber, or wood.

In FIG. 1 the mast 2 supports a plurality of ribs 8 slidably coupled along the mast 2 in a manner that allows them to be raised and lowered. Each rib 8 is comprised of a first side 30 and a second side 30*a* that are joined together at an angle along an interrupted common inner edge 32 that extends longitudinally from a leading edge 33 to a trailing edge 34. The common inner edge 32 is interrupted by an aperture 20 that extends through the common inner edge 32 and the first side 30 and second side 30*a*. The rib aperture 20 is sized to enable coupling of the rib 8 with the mast 2 for pivotal movement of the rib 8 about a rib axis 36 and for sliding movement of the rib 8 along the mast 2. Preferably, the aperture 20 is located approximately at a distance of 25 percent of the length of a chord line that extends from the leading edge 33 to the trailing edge 34. Locating the aperture near this position helps to reduce the moment that is induced by the airfoil shape. It should be noted that the optimum aperture location will vary depending on the airfoil shape. In order to constrain rotation movement of the ribs 8 about the longitudinal mast axis 5 the aperture 20 needs to be configured in a non-circular shape. Preferably, the aperture 20 will be rectangular, having been shaped by rectangular notches in the first and second sides.

Each of the rib sides has a cambered outer edge 31 that extends longitudinally from the leading edge 33 to the trailing edge 34 that supports an airfoil surface. Preferably, this outer edge 31 will be rounded to reduce chafing against the flexible cover 24. The angle between the first side 30 and the second side 30*a* of the rib 8 can vary between close to 1 degree and 179 degrees. While the invention remains functional within a range of angles, the preferred angle is approximately 90 degrees. In the preferred embodiment the second side 30*a* of the rib will substantially be a mirror image of the first side 30. This will ensure that in the neutral position, the airfoil will have a symmetrical shape. It is understood that the two sides are not required to be mirror images in order for the invention to work.

Figure 13:
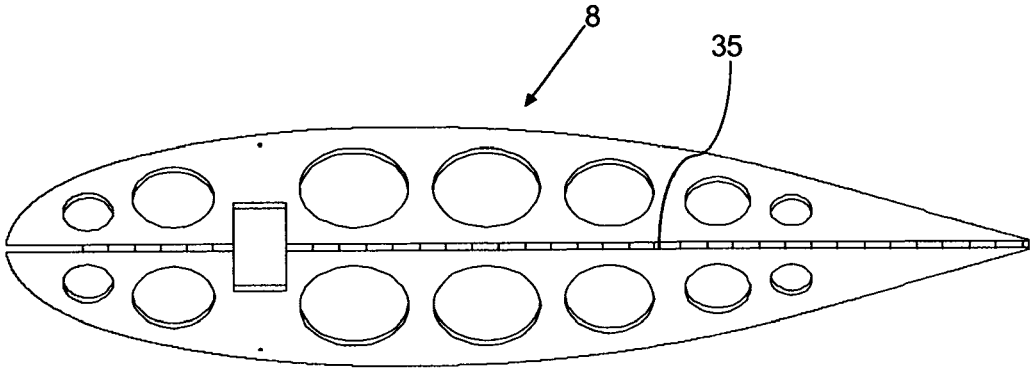
FIG. 13 is a top view of an alternative embodiment for a rib having a hinged coupling shown in symmetrical orientation.

While the ribs 8 may be constructed out of various materials and methods, it is recommended that they are comprised of a light weight composite material. In order to further reduce the weight of the ribs 8, round apertures 18 can be made in various sizes in each side of the rib 8 to reduce the amount of material that the ribs 8 are made of while still retaining the majority of their strength. Ideally, the ribs would be made in one piece such as injection molded plastic. Alternatively, each side of the rib could be coupled by gluing or fusing the panels. Another option would be to hingedly join the first side 30 with the second side 30*a* with a hinge 35 and a pin configuration as shown in FIG. 13.

Figure 5:
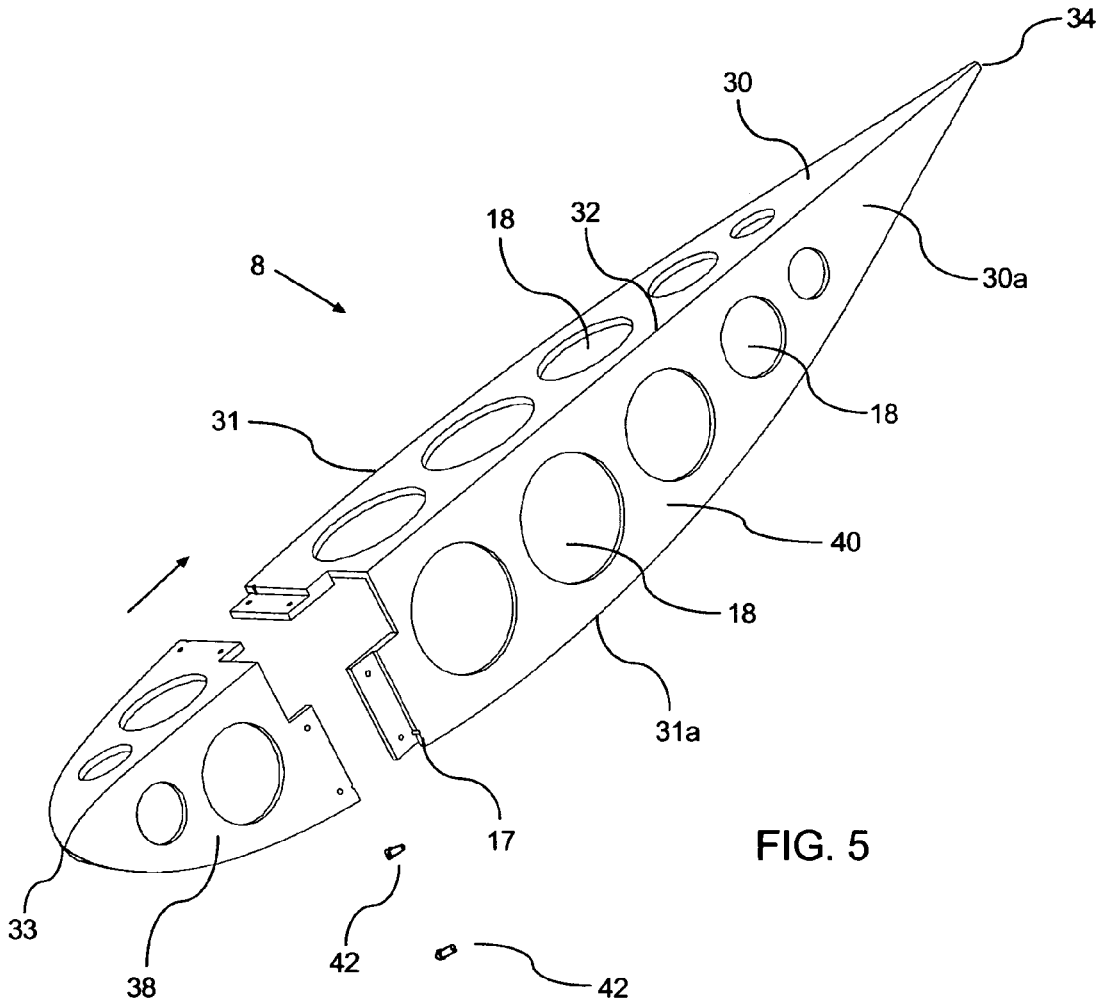
FIG. 5 is a perspective exploded view of a rib shown in an alternative embodiment.

In another embodiment seen in FIG. 5, a rib 8 can be removed from the mast 2 by splitting the rib 8 into two parts, a forward portion 38, and a rearward portion 40, where the forward portion 38 includes a part of the rib aperture 20 and is releasably adjoined to the rearward portion 40 which includes the remaining part of the rib aperture 20. This allows the ribs 8 to be removed from the mast 2 without having to slide the ribs 8 over the end of the mast 2. In the embodiment shown in FIG. 5, the two parts 38, 40 are held together by mechanical fasteners 42. It is understood that an alternative means for removing the ribs 8 from the mast 2 in addition to the above means would be familiar to someone skilled in the art.

Figure 2:
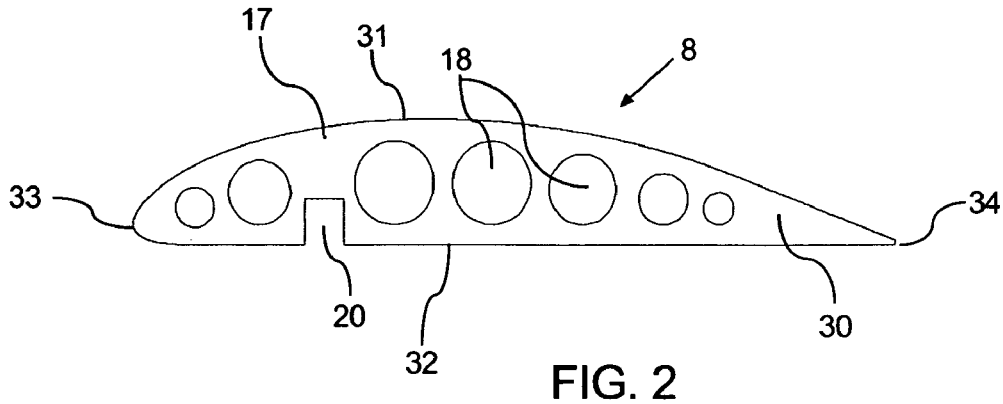
FIG. 2 is a top view of a rib shown in FIG. 1 demonstrating an asymmetrical camber position.

FIG. 2 shows a top view of the rib 8 rotated along a rib axis 36, illustrating an asymmetrical camber position. In this position, the rib is said to be at its maximum. A trim line aperture 17 located near the cambered outer edge 31 of the rib 8 is used for attaching a trim line 22 (FIG. 1) to the rib 8.

Figure 3:
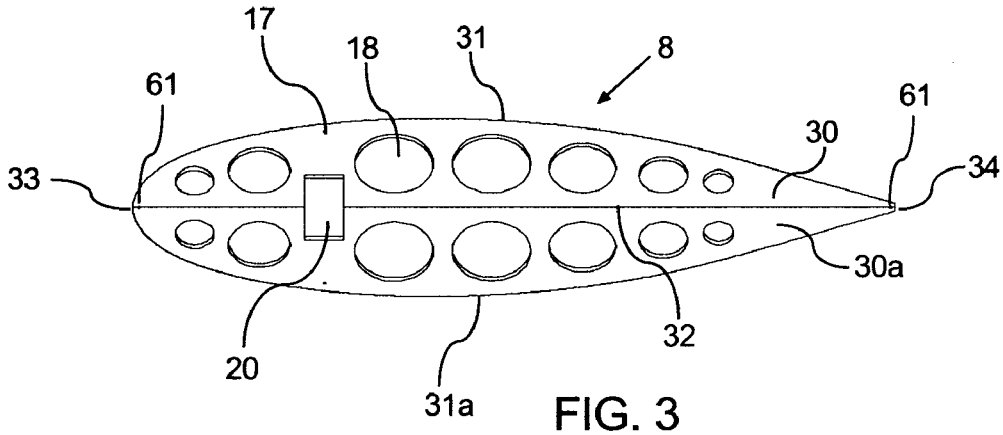
FIG. 3 is a top view of the rib shown in FIG. 2 rotated 45 degrees along the rib axis demonstrating a neutral position.
Figure 4:
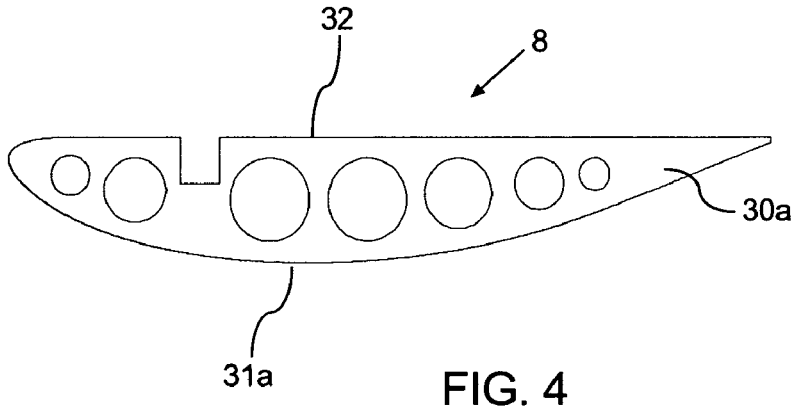
FIG. 4 is a top view of the rib shown in FIG. 2 rotated 90 degrees along the rib axis demonstrating asymmetry in a different direction.

The camber or trim of the wing sail 1 can be adjusted to other positions by pivoting the rib 8 in a rockable manner about the mast 2. In the position shown in FIG. 3, the camber of the rib 8 is symmetrical and is said to be at its minimum. FIG. 4 illustrates the camber in a position opposite to that shown in FIG. 2. The ability to reverse the camber from one side of the mast to the other is an important aspect of the invention, as it allows a wing sail to shift the lift from one side of the sail to the other such as when tacking. The rib assembly 8 can also be adjusted to positions in between the minimum and maximum camber.

To adjust the airfoil shape shown in FIG. 1, a pair of trimming lines 22 pass up through the mast 2 and out over a pair of trim line pulleys 44 located near the top of mast 47 and are attached to the sides 30,30*a* of the rib 8 through the trim line apertures 17. By pulling on one or the other of the trimming lines 22 the camber of the wing sail is adjusted from its maximum to minimum camber. Preferably, the trimming lines 22 are flexible lines similar to those conventionally used on sails.

FIG. 1 illustrates a flexible spacer 10, for example, but not limited to, a wire which is affixed to each rib 8 and extends between each rib 8 in a manner that spaces each rib 8 equal distance from each other along the mast 2. The spacers 10 are attached to an upper support 6 which is raised and lowered in a conventional manner by pulling on a halyard line 12 which passes up through the centre of the mast 2 and exit over a halyard pulley 45 located near the top of mast 47 and attach to the upper support 6.

The upper support 6 shown in FIG. 1 has an aperture that allows it to move slidably up and down the mast 2 but constrains the rotation about the mast axis 5. The lower support 14 shown in FIG. 1 also has an aperture that constrains the rotation about the mast axis 5 and is connected to the mast 2 by a pin 16.

Figure 6:
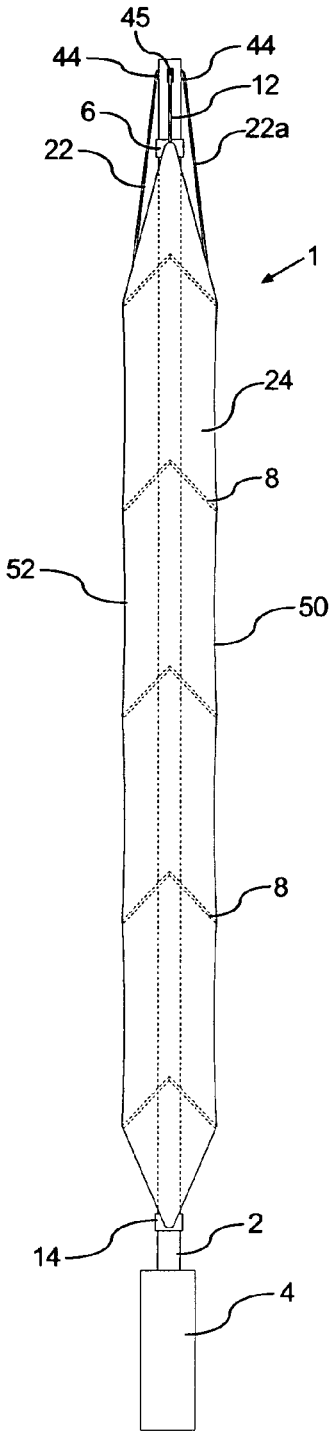
FIG. 6 is a front view of a wing sail shown raised with the ribs in a symmetrical camber orientation.

FIG. 6 provides a view of the front of the wing sail 1 in a raised or hoisted position where the camber of the airfoil is in its minimum or neutral position. A flexible cover 24 is wrapped around or encloses all of the ribs 8 to provide two sides 50, 52 defining a cavity 54 and is secured along the top of the cover 56 and bottom of the cover 58 by the upper support 6 and lower support 14. When raising the wing sail 1, the ribs 8 slide vertically along the mast 2, along with the upper support 6 by pulling on the halyard line 12. This action tensions the flexible cover 24 and causes it to take the profile shape of the rib 8.

Figure 7:
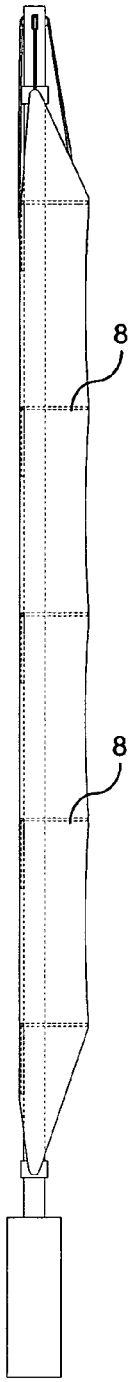
FIG. 7 is a front view of the wing sail shown in FIG. 6 with the ribs in an asymmetrical camber orientation.

FIG. 7 is similar to the view shown in FIG. 6 except that the airfoil is shown in its maximum camber position. In this raised position, the wing sail 1 can be rotated about the base 4 and set at the desired orientation to the prevailing wind.

Figure 8:
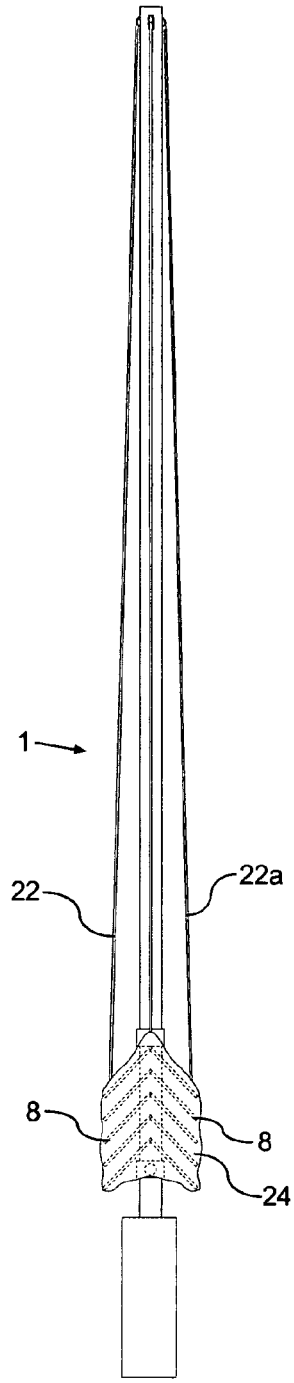
FIG. 8 is a front view of the wing sail in shown FIG. 6 with the ribs in a lowered position.

The flexible cover 24 can be lowered by releasing the tension in the halyard line 12 and allowing the ribs 8 to slide down the mast 2 to the lower support 14, as shown in FIG. 8. The flexible cover 24 will collapse between the ribs 8 in a bellows-like fashion with each rib 8 nesting on top of one another when set in the minimum camber position. The flexible cover 24 can easily be raised and lowered using the halyard line 12 similar to a conventional sail.

Partially lowering, or "reefing" the flexible cover 24 during heavy winds such as during a storm is often desirable. With the flexible cover 24 partially lowered, ties or loops (not shown) along the outside edge of the flexible cover 24 can be attached to hooks or fasteners (not shown) located on the lower support 14. The spacers 10 can also be reefed or attached to the lower support 14 to allow tension to be created in the flexible cover 24 when pulling on the halyard line 12. Functional control of the camber and rotation of the wing sail 1 can still be maintained when reefed.

FIG. 9 shows a side view of a pair of the wing sails 1 mounted on a sail boat 28. In this configuration, the two wing sails 1 can be mechanically linked so that they are able to turn in unison. When heading down wind, they can be turned to provide a larger surface to capture the wind, in a manner similar to a conventional spinnaker. While the embodiment shown is most suitable for use on a wind powered watercraft such as a sailboat 28, it will be appreciated that other uses for the wing sail 1 are possible. For example, wind powered generators or land and ice vehicles would benefit from this invention. While the wing sail 1 has been shown in a rectangular manner with a straight leading and trailing edge in the figures discussed above, the wing sail 1 may also be tapered to reduce mast 2 twist. The mast 2 may also have an oval or circular cross section such that sufficient arrangement is made to prevent the ribs 8 from rotating about the mast axis 5 while still allowing them to pivotally and slidably couple with the mast 2.

Figure 10:
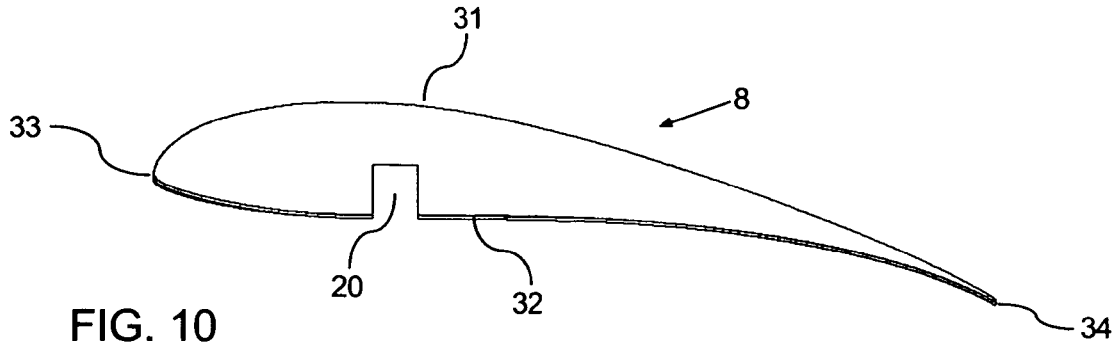
FIG. 10 is a top view of an alternative embodiment for a rib demonstrating asymmetrical camber.
Figure 11:
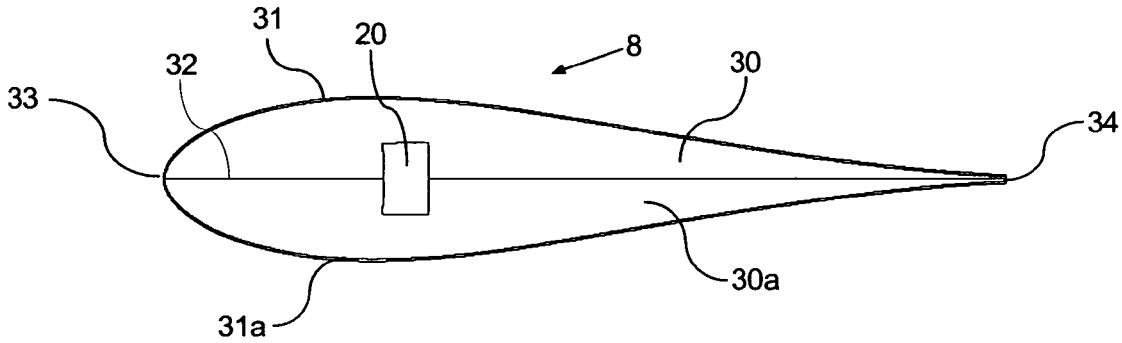
FIG. 11 is a top view of the rib shown in FIG. 10 rotated 45 degrees demonstrating a symmetrical orientation.
Figure 12:
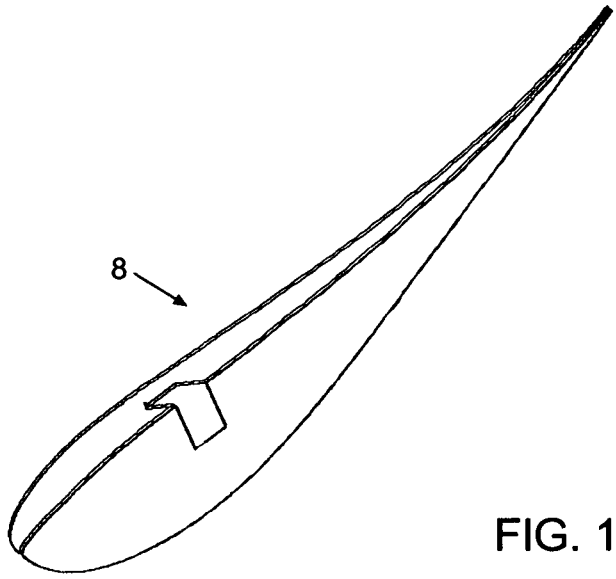
FIG. 12 is a perspective view of the rib shown in FIG. 11.

FIG. 10 illustrates an alternative embodiment of the rib 8 shown in a maximum lift orientation. This demonstrates that the common inner edge 32 of the rib 8 does not have to be straight. FIG. 11 shows a top view of the rib 8 shown in FIG. 10 in a minimum or neutral orientation. FIG. 12 provides a perspective view of the rib 8 shown in FIG. 10.

Figure 14:
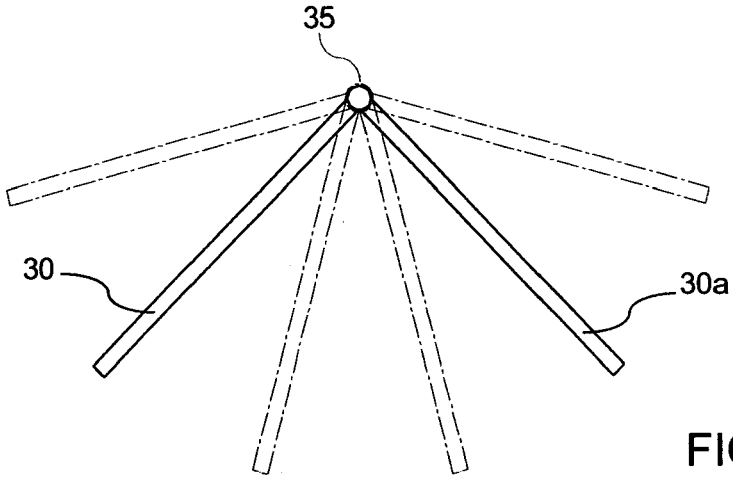
FIG. 14 is a front view of the rib shown in FIG. 13 with the panels oriented at various angles to each other.
Figure 15:
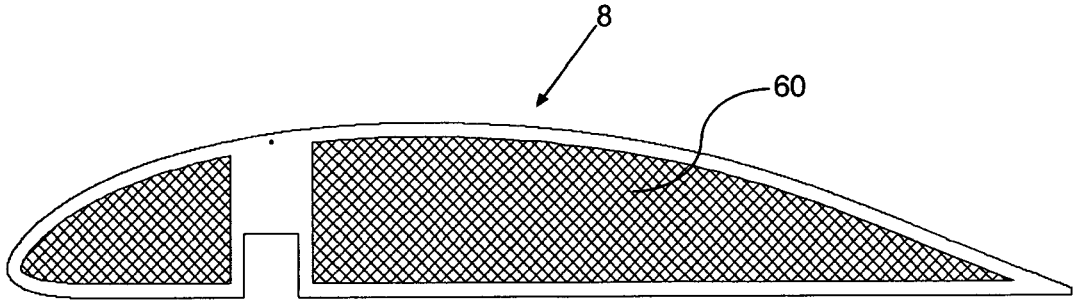
FIG. 15 is a top view of an alternative embodiment for a rib having a reticulate form shown in asymmetrical orientation.

FIG. 14 is a front view of the alternative rib 8 shown in FIG. 13 having a hinged coupling. It shows the rib sides 30,30*a* in positions having various angles with respect to each other. In this embodiment, the rib sides 30,30*a* could rotate independent of each other. This would allow for a greater range of airfoil shapes In another alternative embodiment of the rib 8, the rib sides 30,30*a* may be comprised of a reticulate or net like form. FIG. 15 shows a top view of a rib 8 having a mesh 60 providing support. This has the advantage of reducing the overall weight of the rib 8.

While the wing sail 1 may be controlled manually, provisions may be made that allow the sail 1 to be self oriented with regard to the angle of attack and the apparent wind. This may be accomplished by attaching a tail vane (not shown). The tail vane would automatically keep the sail 1 at the desired angle of attack and maximize the lift efficiency. A plurality of sails 1 could be mechanically linked to the sail 1 that has a tail vane and therefore act in unison.

Figure 16:
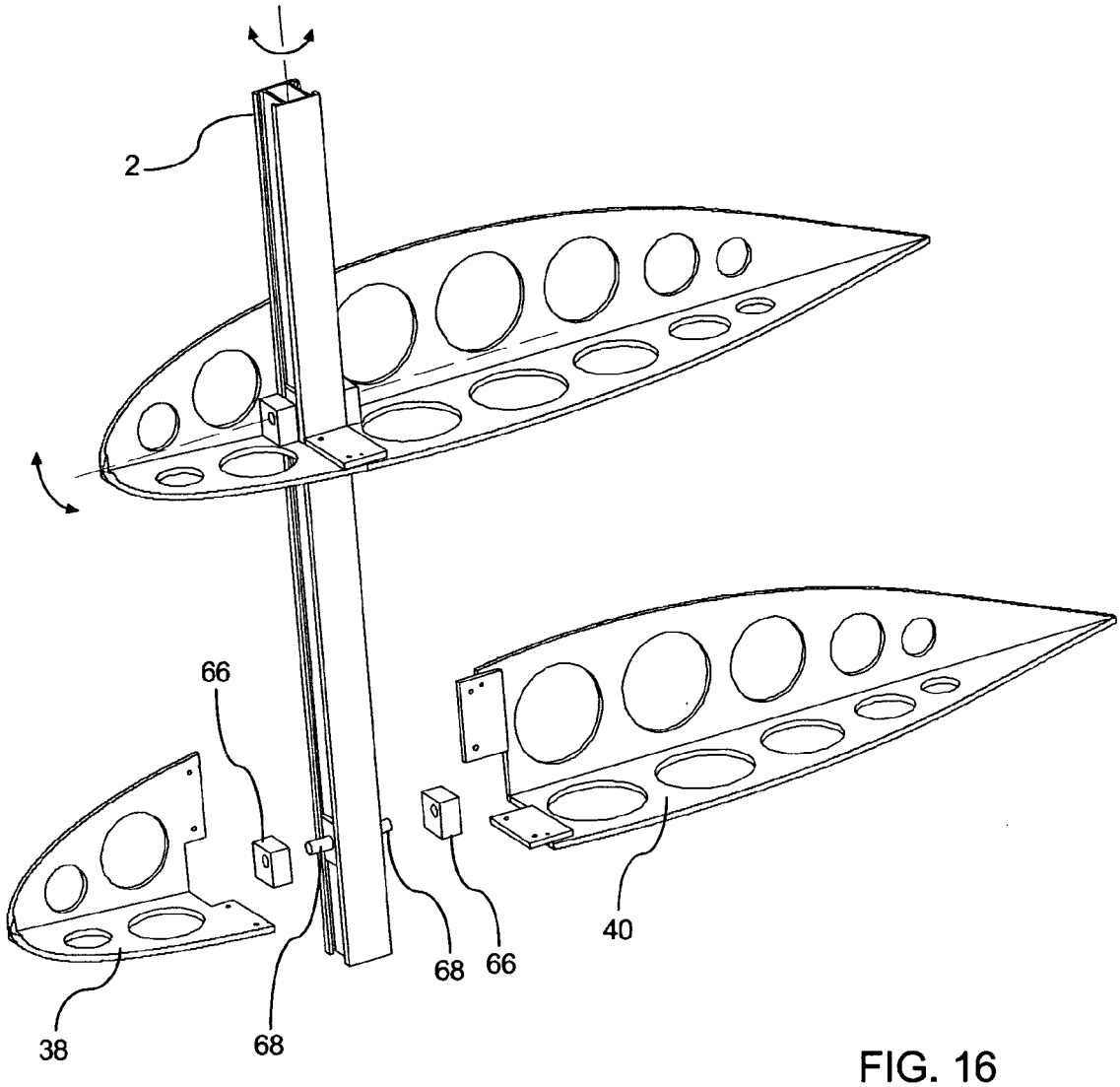
FIG. 16 is an inverted perspective view of an alternative embodiment of a coupling means for the ribs shown in FIG. 1 having a guide track for sliding and pivoting.

Another alternative embodiment for providing a coupling means between the rib 8 and the mast 2 is shown in FIG. 16. The ribs 8 are shown in an inverted perspective view. In this embodiment, the rib 8 is attached to a rotating block 66 which is then mounted on a sliding pin 68. The mast 2 has a track that retains the sliding pin 68 in a sliding motion along the mast 2. This configuration allows the rib 8 to rockably pivot about the sliding pin 68 while still providing translational motion along the mast 2 and preventing rotation about the mast axis 5.

While certain specific materials are mentioned when describing components of the embodied invention, it will be apparent that the choice of materials will depend on the manner in which the wing sail 1 is used, and will be self evident to one skilled in the art. For example, the sail may be comprised of material conventionally used in sails of sailboats. The ribs may be comprised of, for example, but not to be limited to, polymeric, metallic, or composite material including plywood, strandboard, oriented strandboard, fiberglass, carbon fiber, ceramic, and particle board. The structure of the rib is selected for strength and weight, and therefore, possible structure may include, but are not limited to honeycomb, reticulate and perforated forms. There is also the potential to provide pneumatic ribs, which would preferentially comprise resilient material.

While the present invention has been illustrated in a particular embodiment, it is understood that persons of skill in the art may modify the construction and arrangement without departing from the spirit and scope of the invention as defined in the appended claims. For example, the airfoil assembly may further comprise a tail vane to assist in controlling the angle of attack of the airfoil.

What is claimed is:

1. A wing sail for use with a wind-powered vehicle, said sail comprising:

(a) a rotable mast, said mast having a longitudinally extending mast axis, (b) a plurality of ribs each pivotally couplable with said mast for pivotal movement about an associated rib axis extending transversly in relation to said mast axis, and each slidably movable along said mast when so coupled, each of said rib comprising a first side and a second side, wherein:

i. said sides are adjoined at an angle along an interrupted common inner edge extending longitudinally from a leading edge of the rib to a trailing edge of the rib, said common edge being interrupted by an aperture extending through said common edge and said sides, said aperture being sized to enable coupling of the rib with said mast for pivotal movement of the rib about a rib axis extending transverse to said mast axis and for sliding movement of the rib along said mast; and, ii. each of said sides has a cambered outer edge, said outer edge extending longitudinally from said leading edge to said trailing edge;

(c) a trimming means for engaging said ribs and operative when said ribs are mounted to said mast for pivotally moving said ribs about their associated rib axis between neutral and asymmetrical pivot positions;

(d) lifting means for engaging said ribs and operative when said ribs are mounted to said mast for slidably lifting said ribs along said mast from respective lowermost positions to respective upper positions; and, (e) a flexible cover for extending over ribs to provide a sail surface conforming to and supported by said ribs.

2. The sail as defined in claim 1, wherein said angle is substantially 90 degrees.

3. The sail as defined in claim 1, wherein said aperature is configured to restrain rotational movement of said rib about the longitudinal axis of said mast axis when the rib is coupled to the mast as aforesaid.

4. The sail as defined in claim 1, wherein said aperture is formed by rectangular notches in said first and second sides.

5. The sail as defined in claim 4, wherein said aperture is located at a distance from said leading edge approximately 25 percent of the length of a chord line extending from said leading edge to said trailing edge.

6. The sail as defined in claim 1, wherein said rib comprises a forward portion releasably adjoinable to a rearward portion, said forward portion including a first part of said aperture, said rearward portion including a remaining part of said aperture.

7. The sail as defined in claim 1, wherein said first side is hingedly adjoined to said second side for permitting said angle to be adjusted.

8. The sail as defined in claim 1, wherein said second side is substantially a mirror image of said first side.

9. The sail of claim 1 wherein:

(a) said trimming means comprises trim lines; and (b) said lifting means comprises a halyard line.

10. The sail of claim 1, wherein said mast has a rectangular cross-section.

* * * * *